US012433466B2

(12) United States Patent
De Wit et al.

(10) Patent No.: US 12,433,466 B2
(45) Date of Patent: Oct. 7, 2025

(54) CLEANING DEVICE AND CLEANER NOZZLE DESIGNED TO BE USED IN A CLEANING DEVICE

(71) Applicant: KONINKLIJKE PHILIPS N.V., Eindhoven (NL)

(72) Inventors: Bastiaan Johannes De Wit, Eindhoven (NL); Anke Rieka Meulendijks, Eindhoven (NL); Jamila Midhat, Eindhoven (NL); Orhan Kahya, Eindhoven (NL); Chengang Cao, Eindhoven (NL); Rinse Hendrik Bosma, Eindhoven (NL); Fermín Espín Franco, Eindhoven (NL); Robert Friso Burgers, Eindhoven (NL); Albert Al-Shorachi, Eindhoven (NL); Arjan Sander Vonk, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 448 days.

(21) Appl. No.: 17/917,228

(22) PCT Filed: Mar. 29, 2021

(86) PCT No.: PCT/EP2021/058195
§ 371 (c)(1),
(2) Date: Oct. 5, 2022

(87) PCT Pub. No.: WO2021/204584
PCT Pub. Date: Oct. 14, 2021

(65) Prior Publication Data

US 2023/0157510 A1 May 25, 2023

(30) Foreign Application Priority Data

Apr. 6, 2020 (EP) ..... 20168229

(51) Int. Cl.
*A47L 11/40* (2006.01)
*A47L 11/30* (2006.01)

(52) U.S. Cl.
CPC ..... *A47L 11/4058* (2013.01); *A47L 11/302* (2013.01); *A47L 11/4008* (2013.01); *A47L 11/4072* (2013.01); *A47L 11/4088* (2013.01)

(58) Field of Classification Search
CPC .... A47L 11/085; A47L 11/282; A47L 11/292; A47L 11/302; A47L 11/4083;
(Continued)

(56) References Cited

U.S. PATENT DOCUMENTS 3,744,077 A 7/1973 Smyth
2001/0042282 A1 11/2001 Sjogreen

FOREIGN PATENT DOCUMENTS

EP 1713370 B1 4/2009
EP 2387932 A1 11/2011
(Continued)

OTHER PUBLICATIONS

Extended European Search Report issued in connection with corresponding EP Application No. 20168229.1 dated Oct. 14, 2020.

*Primary Examiner* — Shay Karls
(74) *Attorney, Agent, or Firm* — Maschoff Brennan

(57) ABSTRACT

A cleaning device designed to clean a surface includes a cleaner nozzle to face the surface to be cleaned and to perform a cleaning action on the surface, where the cleaner nozzle accommodates at least one rotatably arranged brush including flexible brush elements having tip portions which are intended to contact the surface. The cleaning device includes a force-actuable mechanism that is responsive to a change of a user force on the cleaning device acting to press the cleaner nozzle against the surface when the cleaner nozzle is in an operational position on the surface, and that
(Continued)

is functional to cause a change of a value of at least one parameter of operation of the cleaning device, thereby enabling more intuitive handling of the cleaning device by a user.

16 Claims, 3 Drawing Sheets

(58) Field of Classification Search
CPC ..... A47L 11/4008; A47L 11/4013; A47L 11/4058; A47L 11/145
See application file for complete search history.

(56) References Cited

FOREIGN PATENT DOCUMENTS

| | | | |
|---|---|---|---|
| GB | 1358177 | A | 6/1974 |
| RU | 2671396 | C1 | 10/2018 |
| WO | 00/74549 | A2 | 12/2000 |
| WO | 2005/074779 | A1 | 8/2005 |
| WO | 2010/041184 | A1 | 4/2010 |
| WO | 2015/086083 | A1 | 6/2015 |

CLEANING DEVICE AND CLEANER NOZZLE DESIGNED TO BE USED IN A CLEANING DEVICE

CROSS-REFERENCE TO RELATED APPLICATIONS

The present application is a U.S. National Phase application under 35 U.S.C. § 371 of International Application No. PCT/EP2021/058195, filed on Mar. 29, 2021, which claims the benefit of European Patent Application No. 20168229.1, filed on Apr. 6, 2020. This application is hereby incorporated by reference herein.

FIELD OF THE INVENTION

The invention relates to a cleaning device designed to clean a surface, comprising a cleaner nozzle that is configured to be put in an operational position on the surface to be cleaned in which the cleaner nozzle faces the surface and is capable of performing a cleaning action on the surface, wherein the cleaner nozzle accommodates at least one brush including flexible brush elements having tip portions for contacting the surface to be cleaned in the operational position of the cleaner nozzle on the surface, and wherein the at least one brush is rotatable about a brush rotation axis.

The invention further relates to a cleaner nozzle configured to be used in a cleaning device designed to clean a surface, wherein the cleaner nozzle is configured to be put in an operational position on the surface to be cleaned in which the cleaner nozzle faces the surface and is capable of performing a cleaning action on the surface, wherein the cleaner nozzle accommodates at least one brush including flexible brush elements having tip portions for contacting the surface to be cleaned in the operational position of the cleaner nozzle on the surface, and wherein the at least one brush is rotatable about a brush rotation axis.

BACKGROUND OF THE INVENTION

WO 2010/041184 A1 relates to a cleaning device for cleaning a surface, which comprises at least one brush that is rotatable in a rotation direction and movable over a surface to be cleaned, whereby the at least one brush is effective in loosening and removing dirt from the surface during operation of the cleaning device. The at least one brush is at least partially surrounded by a nozzle housing of a nozzle arrangement of the cleaning device, and means such as wheels are arranged in the nozzle housing for keeping a rotation axis of the at least one brush at a predetermined distance from the surface to be cleaned, wherein the distance is chosen such that the at least one brush is indented by the surface. The cleaning device is suitable for cleaning with or without a cleaning liquid. In view of the first option, the cleaning device comprises a wetting system for supplying the cleaning liquid to the at least one brush. In case a user of the cleaning device desires to perform a wet cleaning action by means of the cleaning device, the wetting system is activated to supply the cleaning liquid to the at least one brush. As a result, the surface to be cleaned is wetted by means of the at least one brush, and the at least one brush also acts to remove the cleaning liquid from the surface, together with the dirt.

If during a conventional mopping action or brushing action on a surface to be cleaned, a user spots a stain on the surface, he/she handles the mop or brush/broom in such a way as to actively scrub the surface at the position of the stain. In particular, it is normal user behavior to press the mop or brush/broom against the surface to be cleaned with more force in order to scrub harder on the surface at the position of the stain. The cleaning device known from WO 2010/041184 A1 is not designed to enable variation of the extent of scrubbing, and therefore, a user is partially hindered in intuitively handling the cleaning device.

SUMMARY OF THE INVENTION

It is an object of the invention to provide a way of enabling more intuitive handling of a cleaning device as described in the foregoing, at least when it comes to removing stains that appear to need extra scrubbing from a surface to be cleaned.

The invention provides a cleaning device designed to clean a surface, comprising a cleaner nozzle that is configured to be put in an operational position on the surface to be cleaned in which the cleaner nozzle faces the surface and is capable of performing a cleaning action on the surface, wherein the cleaner nozzle accommodates at least one brush including flexible brush elements having tip portions for contacting the surface to be cleaned in the operational position of the cleaner nozzle on the surface, and wherein the at least one brush is rotatable about a brush rotation axis, and a force-actuable mechanism that is arranged in the cleaning device to be actuable under the influence of a change of user force on the cleaning device acting to press the cleaner nozzle against the surface to be cleaned when the cleaner nozzle is in the operational position on the surface, and that is functional to cause a change of a value of at least one parameter of operation of the cleaning device.

It is practical if the cleaning device comprises a body portion that is configured to be connected to the cleaner nozzle and to be taken hold of by a user of the cleaning device. Assuming that the cleaning device comprises such a body portion, indeed, the force-actuable mechanism is provided at the position of at least one of the cleaner nozzle and the body portion. The cleaning device may be equipped with any suitable type of driving mechanism configured to drive the at least one brush during operation of the cleaning device, particularly any suitable type of electric driving mechanism. The invention is applicable in the context of cleaning any type of surface, including soft floor surfaces such as floor surfaces with carpets and hard floor surfaces such as floor surfaces with tiles.

The invention further provides a cleaner nozzle configured to be used in a cleaning device designed to clean a surface, wherein the cleaner nozzle is configured to be put in an operational position on the surface to be cleaned in which the cleaner nozzle faces the surface and is capable of performing a cleaning action on the surface, wherein the cleaner nozzle accommodates at least one brush including flexible brush elements having tip portions for contacting the surface to be cleaned in an operational position of the cleaner nozzle on the surface, wherein the at least one brush is rotatable about a brush rotation axis, and wherein the cleaner nozzle comprises a force-actuable mechanism that is arranged in the cleaner nozzle to be actuable under the influence of a change of user force acting to press the cleaner nozzle against the surface to be cleaned when the cleaner nozzle is in the operational position on the surface, and that is functional to cause a change of a value of at least one parameter of operation of the cleaning device when the cleaner nozzle is actually used in the cleaning device.

According to an insight underlying the invention, it is possible to enable more intuitive use of a cleaning device that is equipped with a cleaner nozzle comprising at least one rotatable brush by providing the cleaning device with a force-actuable mechanism that is responsive to a change of user force exerted on the cleaner nozzle in a direction towards the surface to be cleaned when the cleaner nozzle is in the operational position on the surface, and that is functional to cause a change of a value of at least one parameter of operation of the cleaning device in relation to the change of the user force. The force-actuable mechanism may particularly be capable of causing a change of a mechanical nature as the user force changes, such as a change of relative positioning of at least two components of the cleaning device/cleaner nozzle, and/or a change of an electrical nature as the user force changes, such as a change of an electric signal provided by an electric component.

According to a first practical option existing in the framework of the invention, the force-actuable mechanism comprises a support mechanism of the cleaner nozzle that is designed to support the cleaner nozzle on the surface to be cleaned, wherein the support mechanism includes at least one support element for contacting the surface to be cleaned in the operational position of the cleaner nozzle on the surface, and wherein the support mechanism is configured to enable a distance between the brush rotation axis of the at least one brush and the surface to be cleaned to decrease when the cleaner nozzle is in the operational position on the surface and the user force is increased. Consequently, in the operational position of the cleaner nozzle on the surface to be cleaned, a distance between the brush rotation axis of the at least one brush and the surface can be set under the influence of user force, because the support mechanism is configured such that it is possible to let an increase in user force cause a decrease in distance between the brush rotation axis of the at least one brush and the surface, as a result of which indentation of the at least brush is increased. In this way, it is achieved that normal user behavior involving an increase of user force on the cleaner nozzle when a stain is detected results in enhanced scrubbing by means of the at least one brush, indeed, as the scrubbing action of the at least one brush is enhanced when the brush rotation axis is positioned closer to the surface and indentation of the at least one brush is increased. It is a notable aspect of the invention that the increased level of intuitive use of a cleaning device can be realized on the basis of the configuration of a support mechanism of the cleaner nozzle without a need for other (complex) measures.

It is practical if the cleaner nozzle comprises a brush holder frame, wherein the brush rotation axis of the at least one brush has a fixed position relative to the brush holder frame. In that case, it is advantageous if the support mechanism is configured to enable adjustment of a position of the brush holder frame relative to the at least one support element of the support mechanism in relation to variation of the user force. One way of achieving such functionality of the support mechanism involves providing the support mechanism with at least one resilient element and arranging the at least one resilient element between the at least one support element and the brush holder frame. When the at least one support element is on the surface to be cleaned and increased force is exerted on the brush holder frame in the direction of the surface, the resilient element allows the brush holder frame to move closer to the surface, so that the distance between the brush rotation axis of the at least one brush and the surface can be decreased and the scrubbing action of the at least one brush on the surface can be enhanced.

In the case of the support mechanism including at least one resilient element arranged between the at least one support element and the brush holder frame, the resilient element may act to bias the at least one support element towards a default position relative to the brush holder frame. It is possible that the at least one resilient element is of such a nature that when the cleaner nozzle is in the operational position on a surface to be cleaned, the resilient element causes the brush holder frame to be at a predetermined level relative to the surface as long as no force other than normal user force and force following from the weight of components at a higher position is exerted on the brush holder frame in the direction towards the surface, or in general the force is too low to cause deformation of the at least one resilient element. The at least one resilient element may be a coil spring, for example, although the use of other types of resilient element is feasible as well.

According to a practical possibility existing in the framework of the invention, the at least one support element comprises a pair of wheels, wherein the wheels are rotatable about a common wheel rotation axis. This does not alter the fact that other possibilities are covered by the invention as well, including possibilities involving at least one element that is slidable along the surface to be cleaned rather than rotatable on such surface.

As defined in the foregoing, the at least one brush includes flexible brush elements having tip portions for contacting the surface to be cleaned in the operational position of the cleaner nozzle on such surface, and the at least one brush is rotatable about a brush rotation axis. In the framework of the invention, various specifications can be chosen in respect of the at least one brush. For example, a linear mass density of at least a number of the flexible brush elements of the at least one brush can be chosen to be lower than 150 g per 10 km, at least at the tip portions of the brush elements. Further, the at least one brush may be of the type that is drivable at such a rotational speed that a centrifugal acceleration at the tip portions of the brush elements of at least 3,500 $m/s^2$ can be realized, in particular at the tip portions of brush elements moving out of contact with a surface to be cleaned. It may be practical if the at least one brush is shaped more or less like a roller having a substantially circular cross-section, in which case the brush rotation axis of the at least one brush may coincide with a central longitudinal axis of the roller.

The number of brushes accommodated in the cleaner nozzle may be two, in which case it is practical if the brushes are rotatable in opposite directions about parallel brush rotation axes.

According to a second practical option existing in the framework of the invention, the force-actuable mechanism comprises an electric arrangement including an electric circuit and a switch arranged in the electric circuit, wherein the switch is configured to change position when the cleaner nozzle is in the operational position on the surface to be cleaned and the user force is increased, the moment the user force exceeds a predetermined threshold. Also, it is possible for the force-actuable mechanism to comprise a force sensor or a pressure sensor, for example. In the case of the switch, whether the electric circuit is opened or closed can be taken as an indication of the user force being above or below the predetermined threshold. In the case of the force sensor or the pressure sensor, an indication of a value of the user force can be obtained in an even more accurate way. Generally speaking, the force-actuable mechanism may be configured to generate output that is indicative of a level of force exerted on the cleaner nozzle in the direction towards the surface to be cleaned.

An indication about the value of the user force can be used in a process of controlling operation of the cleaning device. Assuming that the cleaning device comprises a controlling system that is configured to control operation of the cleaning device, such a controlling system may be further configured to receive input from the force-actuable mechanism and take such input into account in determining the value of the at least one parameter of operation of the cleaning device. In respect of the option of having the above-described switch in the cleaning device, it may be practical if the controlling system is configured to change the value of the at least one parameter of operation of the cleaning device when the position of the switch is changed. Examples of the at least one parameter of operation include a rotational speed of the at least one brush, a supply rate of cleaning liquid in case the cleaning device is equipped with a liquid supply mechanism that is configured to supply cleaning liquid to an area of the cleaner nozzle where the at least one brush is located, and an underpressure in case the cleaning device is equipped with a vacuum mechanism. Application of a vacuum mechanism in the cleaning device may be advantageous as a process of picking up dirt from the surface to be cleaned may be improved under the influence of underpressure, counteracting an effect of the dirt getting blown away by the moving brush elements. Additionally or alternatively, vacuum may be used for the purpose of transporting the dirt to a designated area in the cleaning device.

The controlling system of the cleaning device may comprise a microcontroller or the like having a memory in which an operation program is stored. The cleaning device may be equipped with a user interface for allowing a user of the cleaning device to manually influence the way in which the cleaning device is operated by addressing one or more particular algorithms of the operation program and/or temporarily overruling the operation program.

In respect of the possibility of the cleaning device being equipped with a liquid supply mechanism that is configured to supply cleaning liquid to an area of the cleaner nozzle where the at least one brush is located, it is noted that water and a water/soap mixture are practical examples of the cleaning liquid. The liquid supply mechanism may particularly be designed to realize a wet cleaning condition of the at least one brush, in a direct manner and/or an indirect manner, i.e. by spraying/dripping liquid directly on the at least one brush and/or providing liquid to the core of the at least one brush, for example, and/or by spraying/dripping liquid on an area of the surface to be cleaned that is covered by the at least one brush so that the at least one brush is wetted under the influence of contact to that area of the surface.

In a practical embodiment, the liquid supply mechanism includes a pump arrangement configured to supply the cleaning liquid to the area where the at least one brush is located by pumping the cleaning liquid towards such area. In such a case, there is no need for the cleaning device to be provided with additional components for realizing a higher supply rate of cleaning liquid if doing so is determined to be appropriate, as increasing the supply rate of the cleaning liquid may simply involve operating the pump arrangement to run at a higher pumping speed. Additionally or alternatively to operating the pump arrangement to run at a higher pumping speed, the pump arrangement may be operated to address another supply line of the cleaning liquid, particularly a supply line designed to allow larger volumes of cleaning liquid to pass, provided such supply line is present in the cleaning device.

The cleaning device may be a wet/dry cleaning device that is operable in either one of a wet operation mode and a dry operation mode, in which case a user may be provided with a choice to realize a wet cleaning action or a dry cleaning action by means of the cleaning device. In particular, assuming that the cleaning device is equipped with a user interface, the user interface may be configured to communicate a user's command to operate the cleaning device in one of the wet operation mode and the dry operation mode to the controlling system.

In respect of the possible use of cleaning liquid in the cleaning device, it is noted that it may be practical if the cleaning device comprises a reservoir configured to contain the cleaning liquid to be supplied to the area of the cleaner nozzle where the at least one brush is located by means of the liquid supply mechanism and/or if the cleaning device comprises a discharging system configured to receive a liquid/dirt mixture from the at least one brush and to discharge the liquid/dirt mixture to a collection area.

It is to be noted that the option of applying something like the above-mentioned switch or the above-mentioned force sensor or pressure sensor in the cleaning device for the purpose of allowing at least one parameter of operation of the cleaning device to be influenced by a user's action of increasing force on the cleaner nozzle in a direction towards a surface to be cleaned is independent of the option of configuring a support mechanism of the cleaner nozzle such that a scrubbing action of the at least one brush is performed at higher force in the case of a user's action as mentioned.

Formulating some of the above-described options in terms of the cleaner nozzle, it is found that the invention relates to a cleaner nozzle in which the force-actuable mechanism comprises at least one of i) a support mechanism that is designed to support the cleaner nozzle on the surface to be cleaned, wherein the support mechanism includes at least one support element for contacting the surface to be cleaned in the operational position of the cleaner nozzle on the surface, and wherein the support mechanism is configured to enable a distance between the brush rotation axis of the at least one brush and the surface to be cleaned to decrease when the cleaner nozzle is in the operational position on the surface and the user force is increased, ii) an electric arrangement including an electric circuit and a switch arranged in the electric circuit, wherein the switch is configured to change position when the cleaner nozzle is in the operational position on the surface to be cleaned and the user force is increased, the moment the user force exceeds a predetermined threshold, and iii) a force sensor or a pressure sensor of any suitable type, i.e. a sensor configured to determine an actual value of a force or pressure acting at the position of the sensor and to provide output representative of the value in the form of an electric signal or the like.

The invention also relates to a cleaning device for cleaning a surface, comprising at least one cleaning element configured to perform a cleaning action on the surface to be cleaned, a controlling system configured to control operation of the cleaning device, and a force-actuable mechanism configured to provide input to the controlling system that is indicative of a level of force exerted by a user of the cleaning device on the cleaning device in a direction towards the surface to be cleaned, wherein the controlling system is configured to take the input from the force-actuable mechanism into account in determining a value of at least one parameter of operation of the cleaning device. Practical examples of the force-actuable mechanism include the above-mentioned force sensor or pressure sensor and also the above-mentioned electric arrangement including the electric circuit and the switch arranged in the electric circuit.

Various features as described in the foregoing are applicable to the cleaning device defined in the preceding paragraph, including the following: i) the at least one cleaning element may be movably arranged in the cleaning device, ii) the cleaning device may comprise any suitable type of driving mechanism configured to drive the at least one cleaning element during operation of the cleaning device, particularly any suitable type of electric driving mechanism, iii) the at least one cleaning element may comprise a brush, wherein the brush may include flexible brush elements having tip portions for contacting the surface to be cleaned, and wherein the brush may be rotatable about a brush rotation axis, iv) the cleaning device may comprise a cleaner nozzle accommodating the at least one cleaning element, and a body portion that is configured to be taken hold of by a user of the cleaning device, and v) examples of the at least one parameter of operation of the cleaning device include a speed of movement of the at least one cleaning element in case the at least one cleaning element is movably arranged in the cleaning device, a supply rate of cleaning liquid in case the cleaning device is equipped with a liquid supply mechanism that is configured to supply cleaning liquid to an area of the cleaning device where the at least one cleaning element is located, and an underpressure in case the cleaning device is equipped with a vacuum mechanism.

The invention also relates to a cleaner nozzle for use in a cleaning device as addressed in the two preceding paragraphs, particularly a cleaner nozzle accommodating the at least one cleaning element, wherein the force-actuable mechanism may be at least partially included in the cleaner nozzle as well.

The above-described and other aspects of the invention will be apparent from and elucidated with reference to the following detailed description of an embodiment of a cleaning device and various embodiments of a cleaner nozzle comprising two rotatably arranged brushes, as may be part of the cleaning device.

BRIEF DESCRIPTION OF THE DRAWINGS

The invention will now be explained in greater detail with reference to the figures, in which equal or similar parts are indicated by the same reference signs, and in which:

FIGS. 2 and 3 diagrammatically show components of a cleaner nozzle according to an embodiment of the invention, which is part of the wet cleaning device shown in FIG. 1 and a portion of the floor, wherein FIG. 2 illustrates an appearance of the cleaner nozzle that is associated with normal force on the cleaner nozzle in a direction towards the surface to be cleaned and FIG. 3 illustrates an appearance of the cleaner nozzle that is associated with increased force on the cleaner nozzle in the direction towards the surface;

DETAILED DESCRIPTION OF EMBODIMENTS

Figure 1:
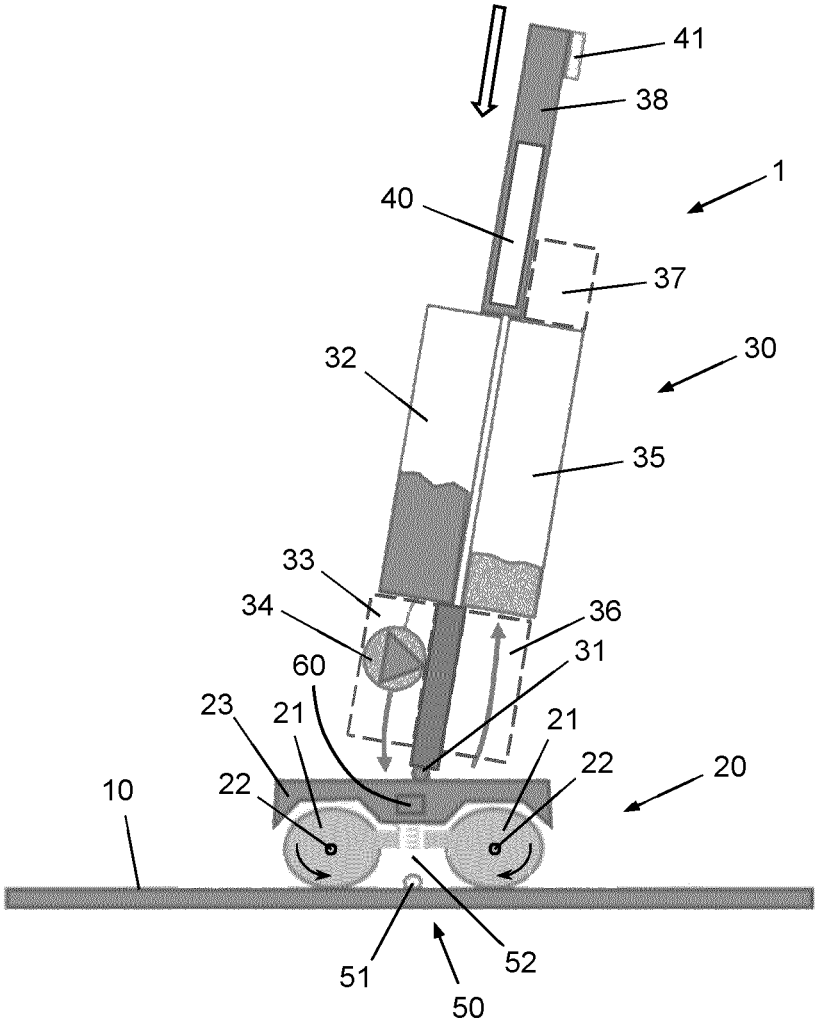
FIG. 1 diagrammatically shows components of a wet cleaning device according to an embodiment of the invention and a portion of a floor having a surface to be cleaned.

FIG. 1 illustrates the design of a wet cleaning device 1 according to an embodiment of the invention. The particular cleaning device represented in FIG. 1 and described in the following is just one example of many types of cleaning devices which are feasible in the framework of the invention. In this respect, it is noted that the invention does not only relate to wet cleaning devices, but also to other types of cleaning devices such as wet/dry cleaning devices having a dry cleaning function besides a wet cleaning function, and vacuum cleaners having a vacuum cleaning function besides a wet cleaning function and possibly also a dry cleaning function.

The wet cleaning device 1 is configured to be used for the purpose of perform a wet cleaning action on a surface 10 such as a floor surface. At a side that is supposed to face the surface 10 during operation of the cleaning device 1, the cleaning device 1 comprises a cleaner nozzle 20 accommodating two brushes 21. In the following, it is assumed that each of the brushes 21 is provided in the form of a roller that is rotatable about a brush rotation axis 22 that is defined by a central longitudinal axis of the roller, which does not alter the fact that other embodiments of the brushes 21 are possible as well. As indicated in FIG. 1 by means of curved arrows depicted at the position of the brushes 21, the brushes 21 are arranged so as to be rotatable in opposite directions about their respective brush rotation axes 22. In the framework of the invention, the cleaner nozzle 20 may accommodate another number of brushes 21, wherein it is particularly to be noted that having just a single brush 21 is a feasible alternative option. The cleaner nozzle 20 comprises a brush holder frame 23 that serves for suspending the brushes 21 in such a way that the brush rotation axes 22 of the brushes 21 have a fixed position relative to the brush holder frame 23. Besides the cleaner nozzle 20, the cleaning device 1 comprises a body portion 30 that is configured to be taken hold of by a user of the cleaning device 1 and that is connectable to the cleaner nozzle 20 through a hinge arrangement 31.

For the purpose of driving the brushes 21 during operation of the cleaning device 1, the cleaning device 1 is equipped with a suitable electric drive mechanism (not shown). For the purpose of powering the drive mechanism and probably also other components of the cleaning device 1, the cleaning device 1 may be connectable to the mains and/or may be equipped with a suitable battery arrangement. Preferably, the cleaning device 1 is a cordless device comprising a rechargeable battery arrangement, in which case it may further be practical if the cleaning device 1 is part of a set including a charging dock besides the cleaning device 1. Such a set may also include a flushing tray that can be used for the purpose of cleaning the brushes 21. In case the cleaning device 1 is not equipped with a battery, a simple dock that is without charging ability may be provided for receiving and holding the cleaning device 1.

The body portion 30 of the cleaning device 1 includes a first reservoir 32 that serves for containing a cleaning liquid, and a liquid supply mechanism 33 that serves for supplying the cleaning liquid to the brushes 21 during operation of the cleaning device 1, and that is positioned between the first reservoir 32 and the cleaner nozzle 20 to that end. The liquid supply mechanism 33 may comprise any suitable type of pump arrangement 34, for example. The body portion 30 of cleaning device 1 further includes a second reservoir 35 that serves for containing used, dirty cleaning liquid, and a discharging system 36 that serves for receiving a mixture of cleaning liquid and dirt from the brushes 21 and for transporting the mixture to the second reservoir 35, and that is positioned between the cleaner nozzle 20 and the second reservoir 35 to that end. The body portion 30 may also include a vacuum mechanism 37 configured to create underpressure that is useful to support transportation of dirt through the body portion 30, in a direction away from the brushes 21, for example.

Although this is not illustrated in FIG. 1, it is practical if the body portion 30 of the cleaning device 1 has a housing for accommodating at least the reservoirs 32, 35, the liquid supply mechanism 33, the discharging system 36, the vacuum mechanism 37 and possible other components of the cleaning device 1 such as the above-mentioned optional battery arrangement. The body portion 30 of the cleaning device 1 comprises a handle 38 so that the user can easily take hold of the body portion 30 and move the cleaning device 1 across the surface 10 to be cleaned as desired.

Basic aspects of how the wet cleaning device 1 is operated are as follows. During operation, the brushes 21 are driven so as to rotate and the liquid supply mechanism 33 is activated so as to supply the cleaning liquid to the brushes 21, as indicated in FIG. 1 by a downward arrow on the left, and to thereby cause the brushes 21 to be in a wet cleaning condition. An area of the surface 10 that is within reach of the brushes 21 is wetted by the brushes 21. Any stains as may be present on the area of the surface 10 are detached under the influence of the cleaning liquid and/or are scrubbed off by the brushes 21, and any dirt as may be present on the area of the surface 10 is removed along with the cleaning liquid that is transported towards the second reservoir 35 by means of the discharging system 36, as indicated in FIG. 1 by an upward arrow on the right. In particular, the brushes 21 include flexible brush elements having tip portions for contacting the surface 10. Dirt and liquid are picked up from the surface 10 by the tip portions of the brush elements and are flung away from the tip portions as the brush rotates and the tip portions move out of contact to the surface 10.

In the shown example, the cleaning device 1 is equipped with a user interface 41 including an on/off button. Assuming an off mode of the cleaning device 1, operation of the cleaning device 1 is initiated when the user depresses the on/off button. The cleaning device 1 comprises a controlling system 40 including a microcontroller that is programmed to put the brushes 21 in motion and to activate both the liquid supply mechanism 33 and the vacuum mechanism 37 in reaction to the user depressing the on/off button. When the user depresses the on/off button once again, the user causes the controlling system 40 to control the cleaning device 1 to stop operating through shutting down power supply to the various functional components of the cleaning device 1.

The cleaning device 1 comprises a support mechanism 50 that is designed to support the cleaner nozzle 20 on the surface 10 to be cleaned in the operational position of the cleaner nozzle 20 on the surface 10. The support mechanism 50 is configured such that when a user of the cleaning device 1 increases force on the handle 38 in a direction towards the surface 10 to be cleaned, indentation of the brushes 21 is allowed to increase. This functionality of the support mechanism 50 is advantageous in that natural user behavior is allowed to yield an effect that complies with user expectations. The fact is that in a situation of a user using the cleaning device 1 for cleaning a surface 10 and the user spotting a stain on the surface 10, a natural response of the user is to press harder on the cleaning device 1. This user behavior follows from experience with conventional cleaning actions in which a scrubbing effect of a cleaning tool such as a mop or a broom on a surface 10 can be enhanced by pressing the cleaning tool more firmly against the surface 10. On the basis of the configuration of the support mechanism 50, increased user force involves increased indentation of the brushes 21 and thereby enhanced scrubbing action of the brushes 21 on the surface 10 to be cleaned.

Figure 2:
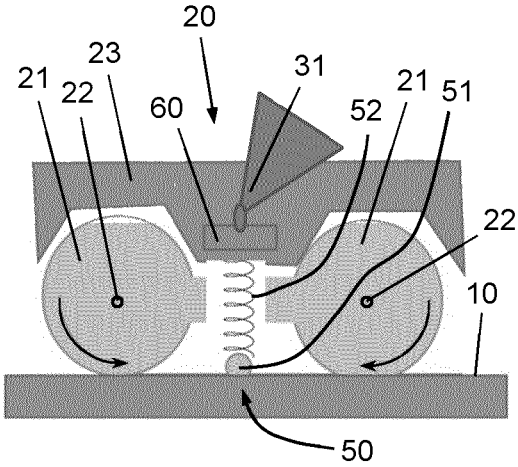
Figure 3:
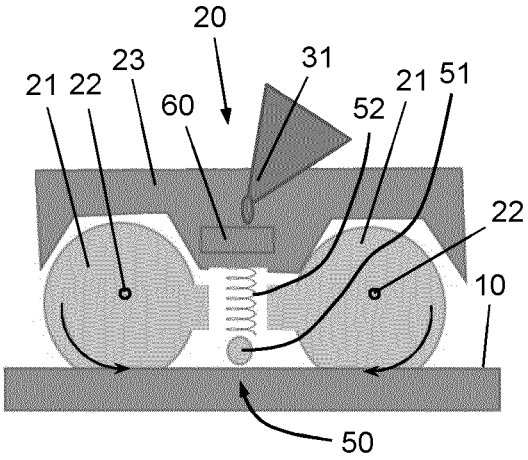

In the example shown in FIGS. 1-3, the support mechanism 50 comprises a support wheel 51 for contacting the surface 10 to be cleaned in the operational position of the cleaner nozzle 20 on the surface 10. The support wheel 51 is arranged at a position between the brushes 21 and is connected to the brush holder frame 23 through a coil spring 52. The properties of the coil spring 52 are chosen such that in a situation of normal force on the cleaning device 1/cleaner nozzle 20 in the direction towards the surface 10 to be cleaned, the force is counteracted by the coil spring 52 and indentation of the brushes 21 is of a standard, initial value. When a user of the cleaning device 1 acts to increase the force to such an extent that the coil spring 52 is compressed, the brush holder frame 23 and the brushes 21 suspended from the brush holder frame 23 are moved closer to the surface 10 to be cleaned, wherein the indentation of the brushes 21 increases to a higher value. For example, in the normal situation, the indentation of the brushes 21 may be about 5%, and in the situation of increased user force, an indentation of the brushes 21 of about 15% of the brush diameter may be realized until the force is released again. In FIG. 1, the force is indicated by means of an arrow extending alongside the handle 38 of the cleaning device 1. FIG. 2 serves to illustrate the normal situation, and FIG. 3 serves to illustrate the situation of increased force. As explained in the foregoing, higher indentation of the brushes 21 may be expected to involve improved cleaning performance.

A coil spring 52 is one practical example of a resilient element as may be applied in the support mechanism 50. The above-described effects may be obtained in an equal manner when the support mechanism 50 would be provided with another type of resilient element. In the shown example, the support mechanism 50 is configured to control brush indentation in dependence of force in an automated, mechanical fashion. The cleaning device 1 may be equipped with any suitable type of mechanism configured to limit the indentation of the brushes 21 at a predetermined maximum value, so that a situation in which central shafts of the brushes 21 are made to contact the surface 10 to be cleaned can be avoided.

As diagrammatically shown in FIGS. 1-3, the cleaning device 1 may further comprise an electric arrangement 60 configured to provide input to the controlling system 40 that is indicative of a force level, wherein the controlling system 40 may be configured to take the input from the electric arrangement 60 into account in determining a value of at least one parameter of operation of the cleaning device 1. An electric arrangement 60 as mentioned may comprise an electric circuit and a switch arranged in the electric circuit, for example. Additionally or alternatively, it is possible for the cleaning device 1 to comprise a force sensor or a pressure sensor (not shown). In such cases, a functionality of providing the controlling system 40 with information about the user force can be realized, which information may be an indication of whether or not the user force is above a predetermined threshold, for example, or may be related to actual values of the user force. On the basis thereof, it is possible to realize effects of the controlling system 40 causing a rotational speed of the brushes 21 to increase, causing a supply rate of cleaning liquid to the cleaner nozzle 20 to increase, causing underpressure to increase in case the cleaning device 1 comprises a vacuum mechanism 37, etc. In this way, other cleaning performance boosting measures may be taken besides creating an enhanced scrubbing effect of the brushes 21 when user force is increased.

The electric arrangement 60 and/or the force sensor or the pressure sensor may be located at any suitable position on the cleaning device 1, wherein it is possible that a position on the cleaner nozzle 20 of the cleaning device 1 is chosen, that a position on the body portion 30 of the cleaning device 1 is chosen, or that one or more components are located at a position on the cleaner nozzle 20 and one or more components are located at a position on the body portion 30.

Figure 4:
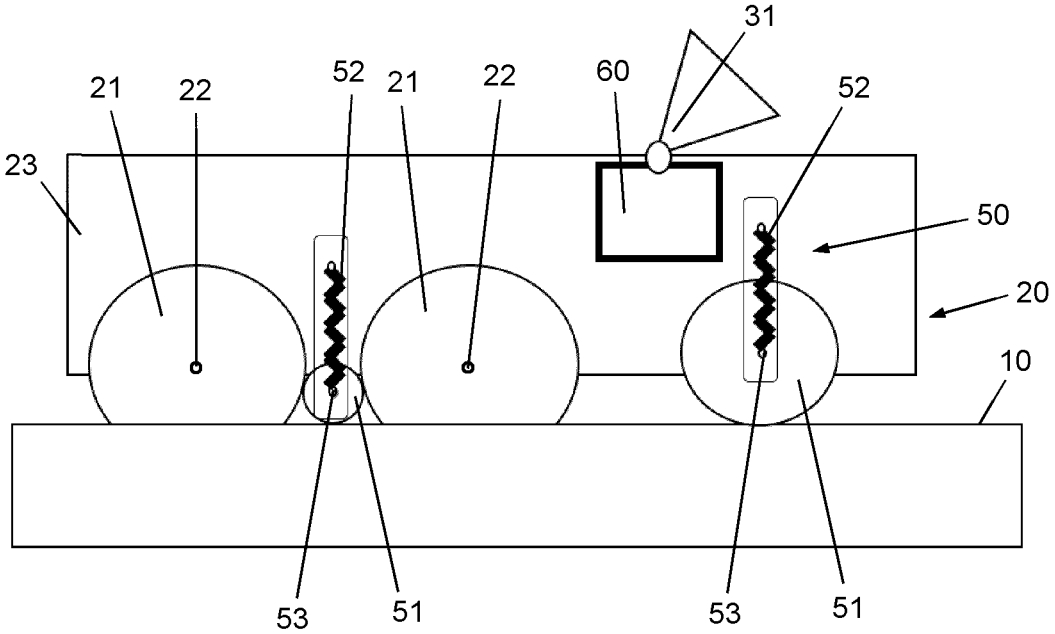
FIG. 4 diagrammatically shows components of a cleaner nozzle according to an alternative embodiment of the invention.

In FIG. 4, an alternative embodiment of the cleaner nozzle 20 is illustrated in order to demonstrate that the support mechanism 50 may comprise more than one support element for contacting the surface to be cleaned 10 and thereby supporting the cleaner nozzle 20 on the surface 10. In the example shown in FIG. 4, the support mechanism 50 comprises two pairs of support wheels 51, i.e. a total of four support wheels 51, wherein one of the two pairs of support wheels 51 is arranged at a position between the brushes 21, and wherein both of the two pairs of support wheels 51 are resiliently mounted to the brush holder frame 23.

Figure 5:
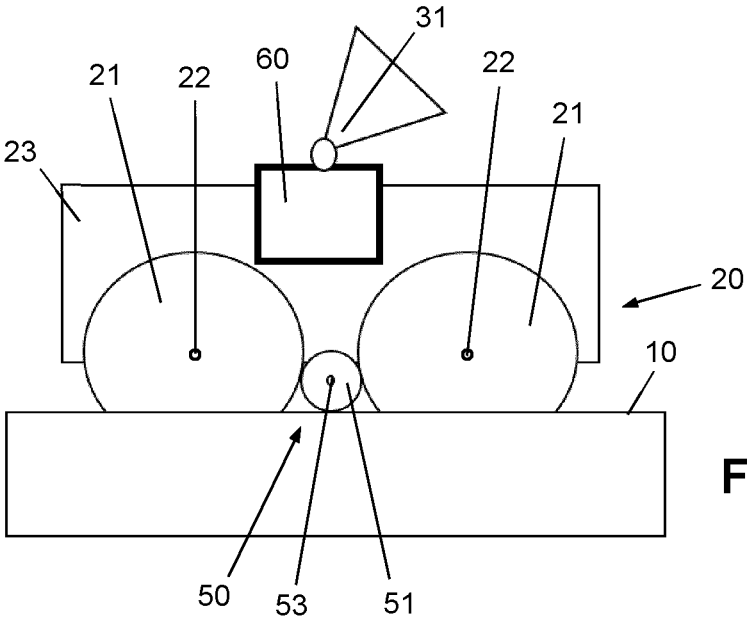
FIGS. 5 and 6 show components of embodiments of a cleaner nozzle of a different constitution in which a position of a wheel rotation axis of respective wheels of the cleaner nozzle for contacting the surface to be cleaned is fixed relative to a brush holder frame of the cleaner nozzle.
Figure 6:
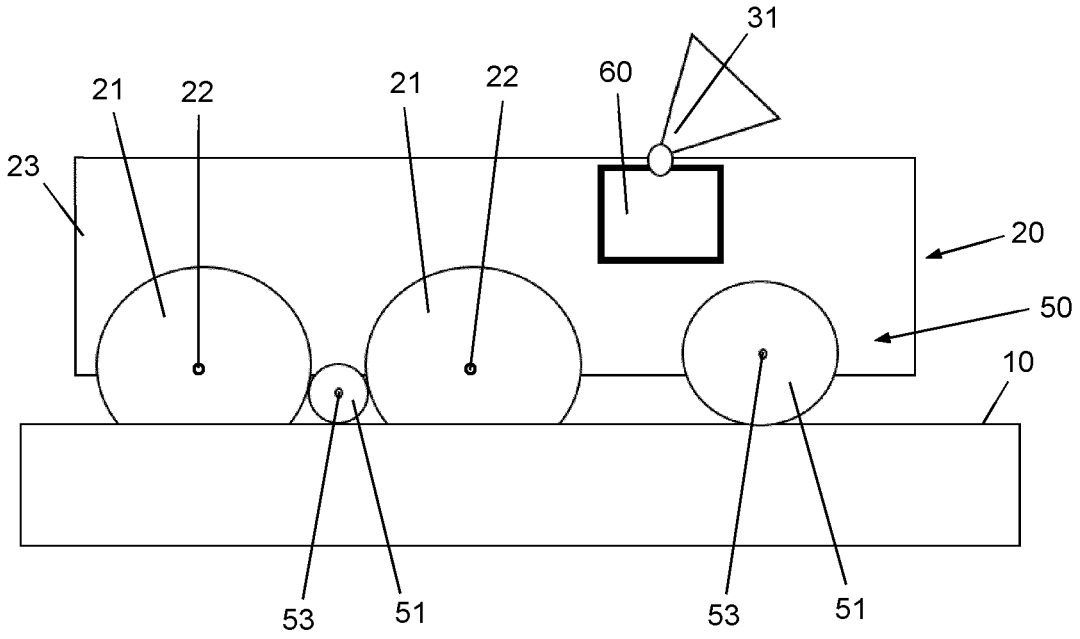

The respective options of having an electric arrangement 60 (and/or a force sensor or a pressure sensor) and having a support mechanism 50 that is designed to control brush indentation in dependence of user force can be applied in the cleaning device 1 independently from each other. In this respect, FIG. 5 illustrates an option of having a combination of an electric arrangement 60 and a support mechanism 50 comprising a single pair of support wheels 51 of which a wheel rotation axis 53 has a fixed position relative to the brush holder frame 23, i.e. a support mechanism 50 that is not capable of controlling indentation of the brushes 21 under the influence of user force. FIG. 6 illustrates a similar combination, wherein the support mechanism 50 comprises two pairs of support wheels 51 of which a wheel rotation axis 53 has a fixed position relative to the brush holder frame 23. A non-illustrated option according to which the cleaning device 1 does not comprise something like the electric arrangement 60 and/or a force sensor or a pressure sensor besides the support mechanism 50 that is designed to control brush indentation in dependence of user force is covered by the invention as well.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

The invention claimed is:

1. A cleaning device designed to clean a surface, comprising:

a cleaner nozzle that is configured to be put in an operational position on the surface to be cleaned in which the cleaner nozzle faces the surface and performs a cleaning action on the surface, wherein the cleaner nozzle accommodates at least one brush including flexible brush elements having tip portions for contacting the surface to be cleaned in the operational position of the cleaner nozzle on the surface, and wherein the at least one brush is rotatable about a brush rotation axis, and a force-actuable mechanism that is arranged in the cleaning device to be actuable under the influence of a change of a user force on the cleaning device acting to press the cleaner nozzle against the surface to be cleaned when the cleaner nozzle is in the operational position on the surface, and that is functional to cause a change of a value of at least one parameter of operation of the cleaning device.

2. The cleaning device of claim 1, wherein the force-actuable mechanism comprises a support mechanism of the cleaner nozzle that is designed to support the cleaner nozzle on the surface to be cleaned, wherein the support mechanism includes at least one support element for contacting the surface to be cleaned in the operational position of the cleaner nozzle on the surface, and wherein the support mechanism is configured to enable a distance between the brush rotation axis of the at least one brush and the surface to be cleaned to decrease when the cleaner nozzle is in the operational position on the surface and the user force is increased.

3. The cleaning device of claim 2, wherein the cleaner nozzle comprises a brush holder frame, wherein the brush rotation axis of the at least one brush has a fixed position relative to the brush holder frame, and wherein the support mechanism is configured to enable adjustment of a position of the brush holder frame relative to the at least one support element of the support mechanism in relation to variation of the user force.

4. The cleaning device of claim 3, wherein the support mechanism includes at least one resilient element arranged between the at least one support element and the brush holder frame.

5. The cleaning device of claim 4, wherein the resilient element acts to bias the at least one support element towards a default position relative to the brush holder frame.

6. The cleaning device of claim 2, wherein the at least one support element comprises a pair of wheels, wherein the wheels are rotatable about a common wheel rotation axis.

7. The cleaning device of claim 1, comprising the at least one brush being rotatable in opposite directions about the parallel brush rotation axis.

8. The cleaning device of claim 1, wherein the force-actuable mechanism comprises an electric arrangement including an electric circuit and a switch arranged in the electric circuit, wherein the switch is configured to change a position when the cleaner nozzle is in the operational position on the surface to be cleaned and the user force is increased, when the user force exceeds a predetermined threshold.

9. The cleaning device of claim 1, wherein the force-actuable mechanism comprises a force sensor or a pressure sensor.

10. The cleaning device of claim 1, comprising a controlling system configured to:

control the operation of the cleaning device, receive an input from the force-actuable mechanism, and take the input to determine the value of the at least one parameter of operation of the cleaning device.

11. The cleaning device of claim 1, wherein the at least one parameter of operation of the cleaning device is chosen from an operation parameter group including a rotational speed of the at least one brush.

12. The cleaning device of claim 11, comprising a liquid supply mechanism configured to supply a cleaning liquid to an area of the cleaner nozzle where the at least one brush is located, wherein the operation parameter group from which the at least one parameter of operation of the cleaning device is chosen includes a supply rate of the cleaning liquid.

13. The cleaning device of claim 1, comprising a body portion configured to be connected to the cleaner nozzle and to be taken hold of by a user of the cleaning device, wherein the force-actuable mechanism is provided at a position of at least one of the cleaner nozzle and the body portion.

14. The cleaning device of claim 13, wherein the body portion comprises a vacuum mechanism configured to create an underpressure to support transportation of dirt through the body portion, in a direction away from the at least one brush.

15. A cleaner nozzle configured to be used in a cleaning device designed to clean a surface, wherein the cleaner nozzle is configured to be put in an operational position on the surface to be cleaned in which the cleaner nozzle faces the surface and performs a cleaning action on the surface, wherein the cleaner nozzle accommodates at least one brush including flexible brush elements having tip portions for contacting the surface to be cleaned in an operational position of the cleaner nozzle on the surface, wherein the at least one brush is rotatable about a brush rotation axis, and wherein the cleaner nozzle comprises a force-actuable mechanism that is arranged in the cleaner nozzle to be actuable under the influence of a change of a user force acting to press the cleaner nozzle against the surface to be cleaned when the cleaner nozzle is in the operational position on the surface, and that is functional to cause a change of a value of at least one parameter of operation of the cleaning device when the cleaner nozzle is used in the cleaning device.

16. The cleaner nozzle of claim 15, wherein the force-actuable mechanism comprises at least one of:

a support mechanism that is designed to support the cleaner nozzle on the surface to be cleaned, wherein the support mechanism includes at least one support element for contacting the surface to be cleaned in the operational position of the cleaner nozzle on the surface, and wherein the support mechanism is configured to enable a distance between the brush rotation axis of the at least one brush and the surface to be cleaned to decrease when the cleaner nozzle is in the operational position on the surface and the user force is increased, an electric arrangement including an electric circuit and a switch arranged in the electric circuit, wherein the switch is configured to change a position when the cleaner nozzle is in the operational position on the surface to be cleaned and the user force is increased, when the user force exceeds a predetermined threshold, and a sensor configured to determine an actual value of a force or a pressure acting at a position of the sensor and to provide an output representative of the actual value.

* * * * *